US005297980A

United States Patent [19]

Barthold

[11] Patent Number: 5,297,980

[45] Date of Patent: Mar. 29, 1994

[54] SUCTIONING AND PUMPING TOY FOR MALLEABLE PLAY MATERIALS

[75] Inventor: Mark J. Barthold, Redondo Beach, Calif.

[73] Assignee: Mattel, Inc., El Segundo, Calif.

[21] Appl. No.: 825,472

[22] Filed: Jan. 24, 1992

[51] Int. Cl.[5] ..... A63H 33/40; A63H 33/30; B05B 1/20; A61M 5/178

[52] U.S. Cl. ..... 446/180; 446/74; 446/475; 446/490; 604/38; 222/78; 239/211

[58] Field of Search ..... 446/71, 72, 73, 74, 446/76, 89, 176, 180, 196, 320, 321, 423, 475, 483, 490, 491; 604/35, 38, 218, 316; 222/78; 239/211, 329

[56] References Cited

U.S. PATENT DOCUMENTS

| | | | |
|---|---|---|---|
| 2,049,872 | 8/1936 | Sera . | |
| 2,071,225 | 2/1937 | Buttigieg . | |
| 2,451,593 | 10/1948 | Washington, Jr. | 446/180 X |
| 2,620,114 | 12/1952 | Graham . | |
| 2,915,986 | 12/1959 | Sisson . | |
| 3,299,891 | 1/1967 | Smeton | 222/78 X |
| 3,965,608 | 6/1976 | Schuman . | |
| 3,986,639 | 10/1976 | Zaccaro | 446/73 X |
| 4,169,336 | 10/1979 | Kuhn . | |
| 4,206,531 | 6/1980 | Haeuptli . | |
| 4,236,347 | 12/1980 | Fauls . | |
| 4,287,819 | 9/1981 | Emerit . | |
| 4,518,367 | 5/1985 | Zaruba et al. . | |
| 4,583,925 | 4/1986 | Hawkins . | |
| 4,586,482 | 5/1986 | Di Pietro | 446/473 X |
| 4,623,319 | 11/1986 | Zaruba et al. . | |
| 4,738,647 | 4/1988 | Renger et al. . | |
| 4,986,820 | 1/1991 | Fischer | 604/218 |
| 4,995,867 | 2/1991 | Zollinger | 604/218 X |
| 5,098,386 | 3/1992 | Smith | 604/35 X |
| 5,145,446 | 9/1992 | Kuo | 446/473 X |

FOREIGN PATENT DOCUMENTS

| | | | |
|---|---|---|---|
| 2102100 | 7/1972 | Fed. Rep. of Germany | 446/473 |
| 481461 | 8/1959 | Italy | 446/475 |

*Primary Examiner*—D. Neal Muir
*Attorney, Agent, or Firm*—Roy A. Ekstrand

[57] ABSTRACT

A suctioning and pumping toy for malleable play materials includes a hollow cylinder having a closed end supporting a nozzle. A piston rod is received within the hollow cylinder and supports a resilient piston. A transversely extending cylindrical barrel housing is supported upon the cylindrical member and defines an interior cavity for receiving a plurality of play articles. A plurality of interrelated toy figures and play articles are variously configured to be utilized in combination with the suctioning and pumping toy together with a malleable play material having viscosity properties which permit the play material to be suctioned into and pumped from the cylindrical bore of the pumping and suctioning toy as the piston rod is moved by the user.

3 Claims, 2 Drawing Sheets

SUCTIONING AND PUMPING TOY FOR MALLEABLE PLAY MATERIALS

CROSS-REFERENCE TO RELATED PATENT APPLICATION

This application is related to a copending application filed Jan. 21, 1992 entitled PLAY MATERIAL COMPOSITION and having Ser. No. 07/823,399, U.S. Pat. No. 5,258,068 which is hereby incorporated herein by reference and which is assigned to the assignee of the present application.

FIELD OF THE INVENTION

This invention relates generally to malleable play materials and particularly to activity toys used in combination therewith.

BACKGROUND OF THE INVENTION

Many toys have been provided through the years for use in combination with malleable materials such as clay, modeling plastic or the like. For example, toy manufacturers have provided various modeling material extruders, molders and sculpting toys. Often, such toys are used in combination with supporting figures. For example, U.S. Pat. No. 4,738,647 issued to Renger, et al. sets forth an ACTIVITY TOY FOR FORMING AND DISSOLVING A FIGURE TOY in which a toy monster figure is formed by shaping a plastic molding material mixed with sodium bicarbonate powder around a toy skeleton. A vertically extending clear reservoir of diluted citric acid solution is provided and, in the normal play pattern, the molded figure is immersed into the dilute citric acid bath and the bicarbonate material is removed to reveal the underlying skeleton.

U.S. Pat. No. 4,623,319 issued to Zaruba, et al. sets forth a FIGURE INCLUDING EXTRUSION MEANS ACTIVATED BY FIGURE APPENDAGES in which a toy figure includes an interior reservoir within which a molded malleable material is received An extruder piston is movable within the interior to force the malleable material outwardly through apertures provided in the figure's exterior as one or more appendages are moved.

U.S. Pat. No. 4,518,367 issued to Zaruba, et al. sets forth a FIGURE INCLUDING MEANS FOR EXTRUDING PLASTIC SUBSTANCE generally similar to the above-described '319 patent and providing similar malleable material extrusion.

U.S. Pat. No. 4,236,347 issued to Fauls sets forth a FLEXIBLE DOLL CLOSURE AND HEAD MOUNTING formed having a molded elastic outer skin and defining an interior cavity filled with a viscous liquid filler. A separate molded head is removably attachable to the figure to permit filling of the figure interior with the viscous material.

U.S. Pat. No. 4,169,336 issued to Kuhn sets forth a STRETCHABLE FIGURE EXHIBITING SLOW RECOVERY HAVING A SKIN OF ELASTIC FILM MATERIAL AND A HOLLOW INTERIOR FILLED WITH A HIGH VISCOSITY MATERIAL.

U.S. Pat. No. 2,323,522 issued to Journette sets forth a FLAT DOLL having an improved matter of affixing hair to the doll.

U.S. Pat. No. 2,0711,225 issued to Buttigieg sets forth a TAPE MEASURE having a fanciful hollow head structure such as a clown head defining a mouth aperture. A simulated tongue extends through the mouth aperture from the head interior. A flexible tape measure reel is supported within the head and is coupled at one end to the tongue allowing the tape measure to be drawn outwardly through the figure's mouth.

Practitioners in the various arts have, in addition, provided a variety of hand operated pumps and similar apparatus. For example, U.S. Pat. No. 4,287,819 issued to Emerit and entitled SOURCE OF VACUUM AND DEVICE FOR MAINTAINING A NEGATIVE PRESSURE IN AN ENCLOSURE U.S. Pat. No. 3,965,608 issued to Schuman and entitled MANUALLY OPERATED SUCTION DEVICE FOR CAPTURING SMALL OBJECTS and U.S. Pat. No. 2,620,114 issued to Graham and entitled FILLING DEVICE FOR GREASE GUNS all set forth similar structures for drawing or suctioning various materials varying from an air volume to high viscosity materials such as lubricating grease. In addition, U.S. Pat. No. 4,583,925 issued to Hawkins and entitled SUCTION PUMP, U.S. Pat. No. 4,206,531 issued to Haeuptli and entitled SUCTION PUMP, U.S. Pat. No. 2,915,986 issued to Sisson and entitled HAND PUMP FOR LIQUIDS and U.S. Pat. No. 2,049,872 issued to Sera and entitled VACUUM PUMP all set forth various hand operated air or fluid pumps having similar structures.

While the foregoing described prior art devices have to different levels of success met the needs of manufacturers and consumers in various art areas, the demanding toy art exhibits a continuing need for evermore varied and inventive toy combinations.

SUMMARY OF THE INVENTION

Accordingly, it is a general object of the present invention to provide an improved activity toy. It is a more particular object of the present invention to provide an improved activity toy which may readily be used in combination with malleable materials and various interrelated play objects.

In accordance with the present invention, there is provided a suctioning and pumping activity play set for use in combination with a malleable play material comprises: a suction and pumping device including a hollow body, a nozzle extending from the body and means for drawing malleable material into the hollow body and expelling it therefrom through the nozzle; and at least one interrelated toy article having a recess for receiving a portion of the nozzle and having an aperture coupled to the recess, the suction and pumping device and the toy article cooperating to cause a quantity of the malleable play material to be passed through the toy article and the nozzle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
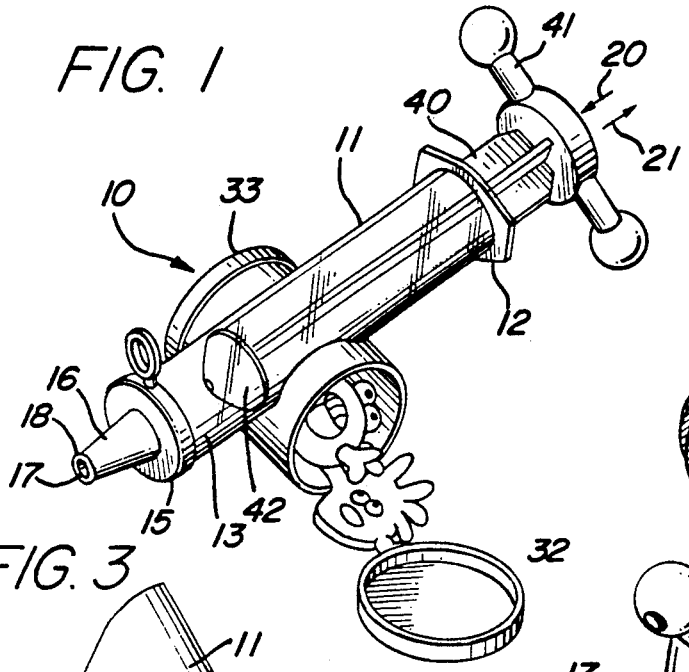
FIG. 1 sets forth a perspective view of a suctioning and pumping toy constructed in accordance with the present invention.

FIG. 1 sets forth a perspective view of a suctioning and pumping toy constructed in accordance with the present invention and generally referenced by numeral 10. Toy 10 includes a generally hollow cylinder 11 defining an interior bore 13 therethrough. A generally planar outwardly extending end flange is secured to one end of cylinder 11. A disk-like end cap 15 is received upon the remaining end of cylinder 11 providing partial closure of interior bore 13 End cap 15 supports a tapered hollow nozzle 16 defining a nozzle aperture 17 therein. Tapered nozzle 16 further defines an outwardly extending lip 18 generally encircling nozzle aperture 17. An elongated piston rod 40 sized and configured to be received within interior bore 13 of cylinder 11 supports a resilient piston 42 having an outer sealing edge 43 configured to correspond generally to the cross-section of interior bore 13. Piston rod 40 further supports a transversely extending handle 41.

A generally cylindrical barrel housing 30 is received upon and secured to the exterior of cylinder 11 and extends transversely with respect to the major axis of cylinder 11. Barrel housing 30 defines an interior cavity 31 within which a plurality of interrelated play articles such as articles 34 and 35 set forth below in greater detail may be received for convenient storage and transportation. A pair of disk-like end caps 32 and 33 are snap-fitted upon the outer edges of barrel housing 30 to complete the closure of interior cavity 31 and thus captivate the desired play articles therein.

In the anticipated play pattern, resilient piston 42 is slidable with respect to the interior of cylinder 11. Thus, the user may create a suction within the portion of interior bore 13 between piston 42 and nozzle aperture 17 by withdrawing handle 41 and piston rod 40 with respect to cylinder 11 in the direction of arrow 20. Conversely, the application of a force upon handle 4 in the direction indicated by arrow 21 drives resilient piston 42 toward nozzle aperture 17 producing a pressurization of the portion of interior bore 13 therebetween.

Figure 2:
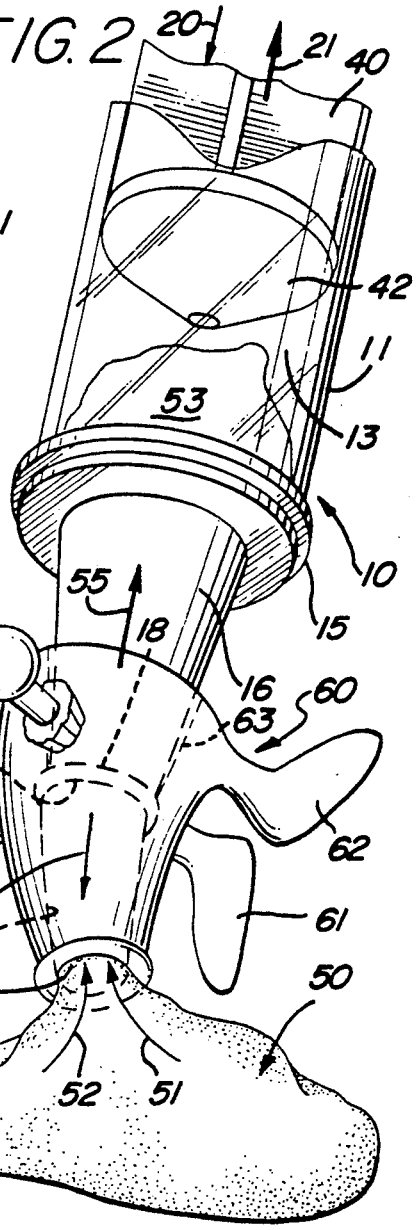
FIG. 2 sets forth a partial section view of the present invention suctioning and pumping toy using an interrelated play object and malleable material.

FIG. 2 sets forth a perspective view of a portion of toy 10 interacting with a quantity of malleable play material generally referenced by numeral 50 and an interrelated toy figure generally referenced by numeral 60. As described above, toy 10 includes an elongated cylinder 11 defining an interior bore 13. A piston rod 40 is received within interior bore 13 and supports a resilient piston 42 in a slidable sealing engagement within bore 13. Piston rod 40 is, as described above, movable within cylinder bore 13 in the directions indicated by arrows 20 and 21. As is also described above, toy 10 includes an end cap 15 supporting a tapered nozzle 16 having an aperture 17 and an extending encircling lip 18.

Interrelated toy FIG. 60 is formed in a fanciful cartoon-like configuration and includes a pair of supporting feet 61 and 62 and an interior tapered passage 63. Passage 63 terminates in an interior groove 66. A passage 64 extends from interior groove 66 of toy FIG. 60 to aperture 65 in the frontal portion thereof. Passages 64 and 63 provide a continuous passage through the entire length of interrelated toy FIG. 60. In the position shown in FIG. 2, tapered nozzle 16 is received within passage 63 while outwardly extending lip 18 thereof is received within groove 66 of toy FIG. 60 to provide a snap-fit attachment between nozzle 16 and toy FIG. 60.

A quantity of malleable play material generally referenced by numeral 50 is shown in FIG. 2 being drawn inwardly through aperture 65 and passages 64 and nozzle 16 to emerge within bore 13 of toy FIG. 10. Thus, it will be apparent to those skilled in the art that in the position shown in FIG. 2, play material 50 is being drawn through toy FIG. 10 in the direction of arrows 51, 52 and 55 due to movement of piston rod 40 in the direction of arrow 20. It will be apparent to those skilled in the art that once a quantity of malleable play material 50 has been drawn into bore 13 of cylinder 11, the movement of piston rod 40 in the direction of arrow 21 causes a reverse flow of play material 50 thereby expelling the play material outwardly through aperture 65 of toy FIG. 60. It will be equally apparent to those skilled in the art that the action of suctioning and pumping the malleable play material may be carried forward repeatedly to produce an interesting and amusing play activity. While it is contemplated that different play materials having the appropriate viscosity may be utilized for play material 50, in its preferred form, play material 50 comprises the composition of material set forth in the above-incorporated copending application. It has been found that this material is particularly suited to use in combination with the present invention suctioning and pumping toy due to its ability to avoid sticking to other materials and its unique viscosity and flow properties.

Figure 3:
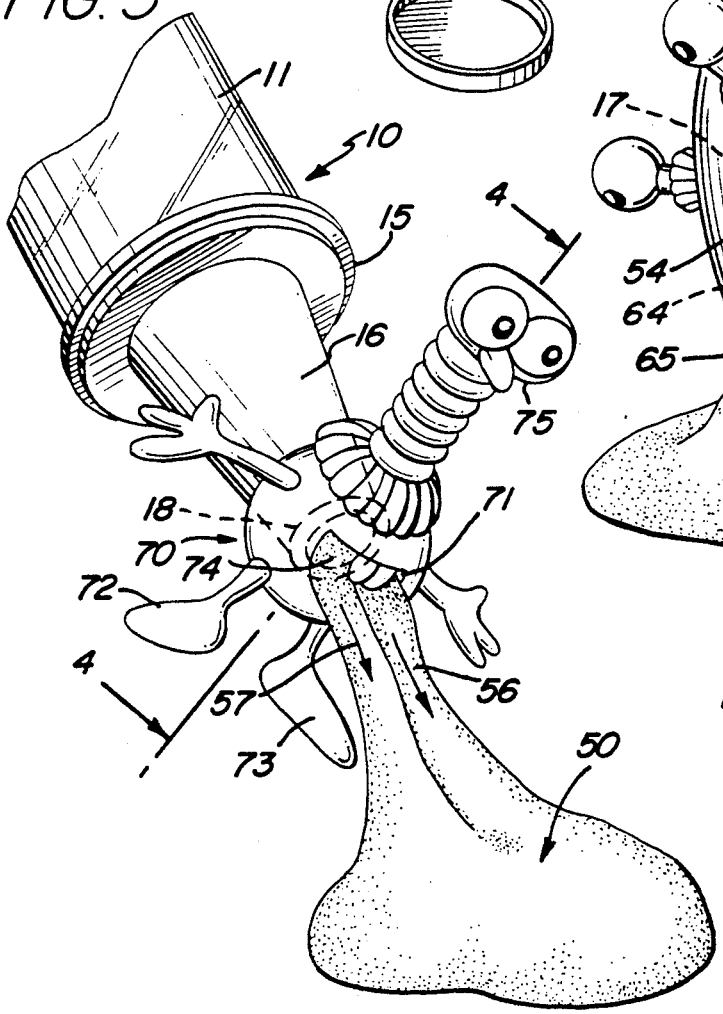
FIG. 3 sets forth a partial section view of the present invention suctioning and pumping toy used in combination with a malleable play material and an alternative interrelated play object.

FIG. 3 sets forth a perspective view of the present invention suctioning and pumping toy used in combination with an alternative interrelated toy figure generally referenced by numeral 70. As is set forth above, toy 10 includes a cylinder 11 supporting an end cap 15 having a nozzle 16 extending therefrom. Nozzle 16 defines an outwardly extending lip 18. An interrelated toy FIG. 70 is configured in a fanciful cartoon-like shape and defines a mouth aperture 71 and an interior cavity 74 in communication therewith. Toy FIG. 70 further includes supporting feet 72 and 73 and a head 75. Interrelated toy figure 70 is formed in the manner better seen in FIG. 4 to receive the end portion of nozzle 16 in communication with interior cavity 74 and mouth aperture 71. Thus, in similarity to the above-described play pattern, a malleable play material 50 may be withdrawn through mouth aperture 71 and interior cavity 74 by the suctioning operation of toy 10 to draw a quantity of play material 50 into cylinder 11 and nozzle 16. Conversely, in the play pattern shown in FIG. 3, a quantity of play material 50 may be forced outwardly from cylinder 11 through nozzle 16 to be disgorged through mouth aperture 71 of interrelated toy figure 70. Once again, it will be apparent to those skilled in the art that while the example shown in FIG. 3 depicts play material 50 flowing outwardly from toy FIG. 70 in the directions indicated by arrows 56 and 57, the reverse operation may be carried forward to suction play material 50 into cylinder 11 through interrelated toy FIG. 70.

Figure 4:
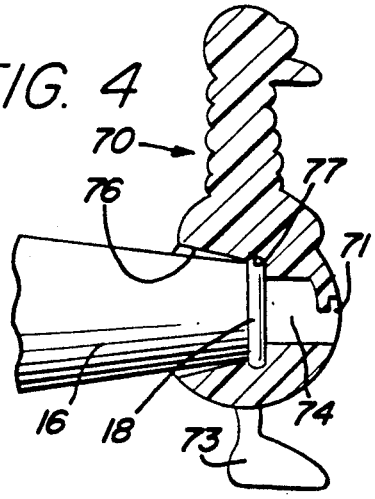
FIG. 4 sets forth a section view of the present invention sectioning and pumping toy taken along section lines 4—4 in FIG. 3.

FIG. 4 sets forth a section view of interrelated toy FIG. 70 taken along section lines 4—4 in FIG. 3. Toy figure 70 defines a tapered interior passage 76 and an annular groove 77. A mouth aperture 71 is formed on the outer surface of toy FIG. 70 and an interior cavity 74 extends between passage 76 and mouth aperture 71. In accordance with the inventive structure set forth above, nozzle 16 of toy 10 (seen in FIG. 3) is received within passage 76 such that lip 18 is snap-fitted within groove 77 therein. When so coupled, a removable attachment between toy FIG. 70 and nozzle 16 is provided and the play pattern set forth in FIG. 3 may be carried forward.

Figure 6:
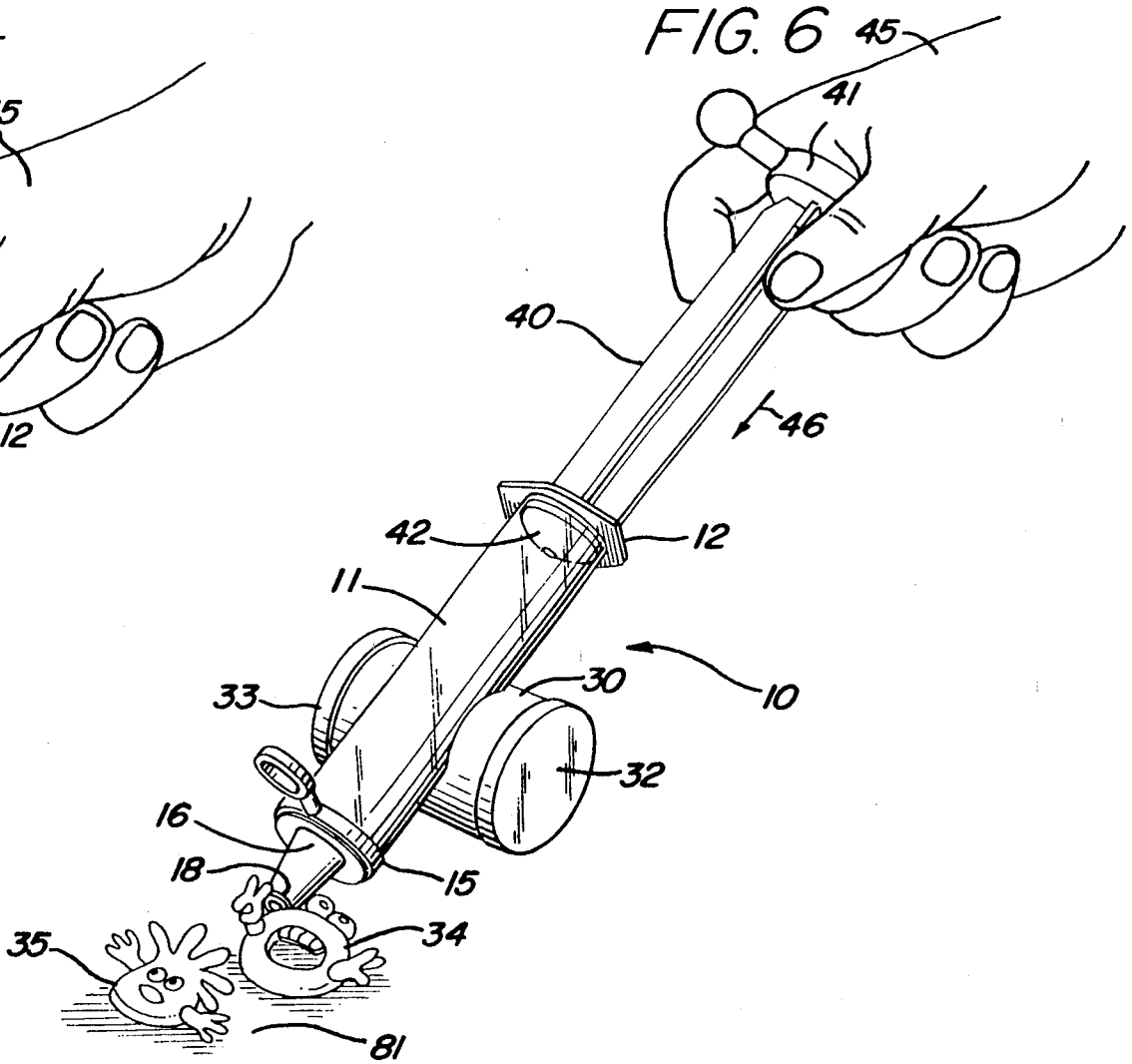
FIG. 6 sets forth a perspective view of the present invention suctioning and pumping toy at the completion of the play pattern shown initiated in FIG. 5.
Figure 5:
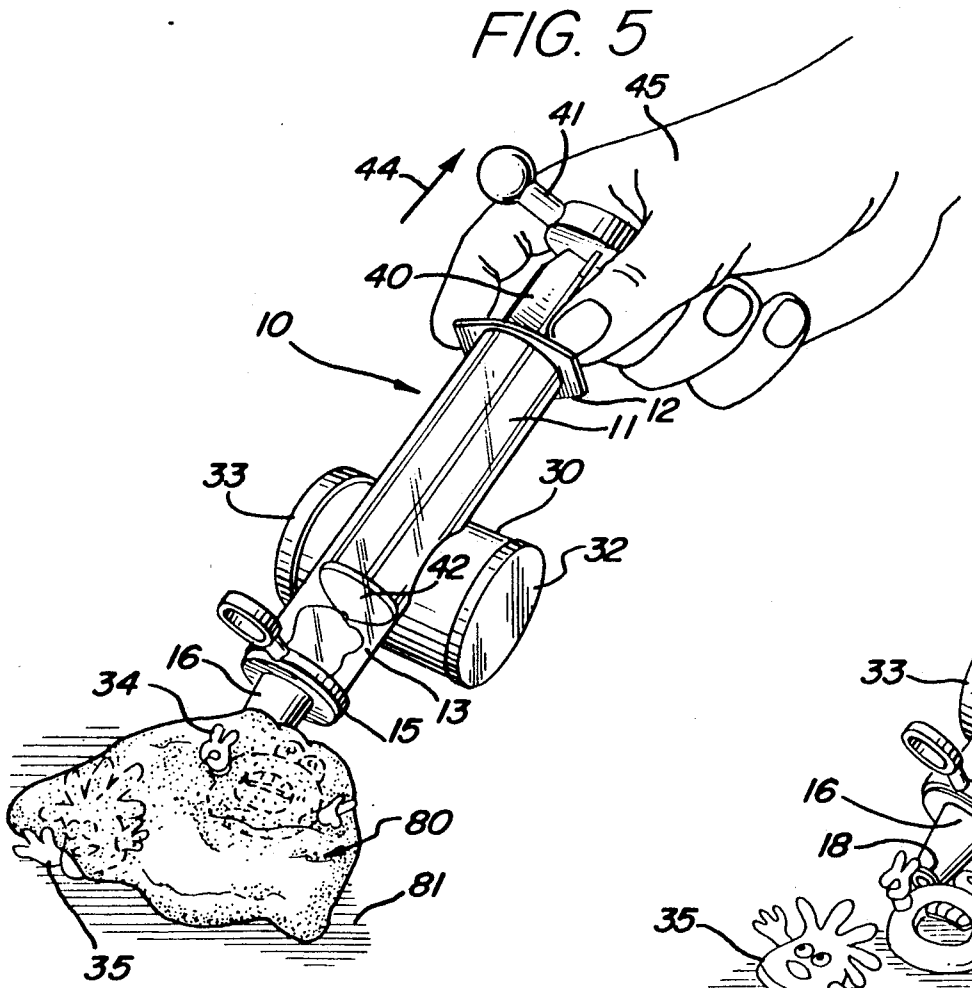
FIG. 5 sets forth a perspective view of the present invention suctioning and pumping toy used in combination with interrelated play objects and malleable play materials.

FIGS. 5 and 6 set forth an alternate play pattern for the present invention suctioning and pumping toy in combination with malleable play material and interrelated play articles.

Specifically, FIG. 5 sets forth toy 10 having the above-described cylindrical member 11 defining an interior bore 13 and an outwardly extending end flange 12. Toy 10 further includes an end cap 15 having a tapered nozzle 16 extending therefrom. A transversely extending barrel housing 30 defines an interior cavity (seen in FIG. 1) for receiving play articles and supports a pair of end caps 32 and 33. A piston rod 40 includes a handle 41 and is received within cylinder bore 13 of cylinder 11. Piston rod 40 supports a resilient piston 42.

In the play pattern shown in FIG. 5, a quantity of malleable play material 80 is received upon a play surface 81 and envelops a plurality of interrelated play articles or toy figures such as articles 34 and 35. In the anticipated play pattern, nozzle 16 is inserted into play material 80 afterwhich piston rod 40 is drawn outwardly from cylinder 11 in the direction indicated by arrow 44. The outward motion of piston rod 40 moves piston 42 correspondingly creating a partial vacuum within the portion of bore 13 between piston 42 and nozzle 16. This partial vacuum causes play material 80 to be suctioned into bore 13 and thereby removed from the embedded play articles such as play articles 34 and 35.

FIG. 6 sets forth the completion of the play pattern described in FIG. 5 in which piston rod 40 has been withdrawn to its maximum travel from cylinder 11 causing play material 80 to be suctioned into bore 13 of cylinder 11 and thereby completely liberating play articles 34 and 35.

At the point shown in FIG. 6, the play pattern may be reversed by forcing piston rod 40 inwardly to in turn force piston 42 into bore 13 of cylinder 11 in the direction of arrow 46. This inward motion of piston 42 causes the play material within bore 13 to be pumped or forced outwardly from nozzle 16 and partially or completely envelop play articles 34 and 35. Once again, it will be apparent to those skilled in the art that the play pattern shown in FIGS. 5 and 6 may be reversibly repeated through virtually any number of desired cycles or partial cycles.

What has been shown is a novel suctioning and pumping toy for use in combination with malleable play materials and interrelated play articles or figures. The play activity provided permits a virtually endless combination of play patterns in which the malleable play material may be suctioned from or through the play articles or pumped about or through the play articles in accordance with the creativity of the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A suctioning and pumping activity play set for use in combination with a malleable play material comprising:

a suction and pumping device including a hollow body, a nozzle extending from said body defining a nozzle end having a first snap-fit engagement means supported thereon and means for drawing malleable material into said hollow body and expelling it therefrom through said nozzle; and at least one interrelated toy article having a body portion defining a recess for receiving said nozzle end of said nozzle and a second snap-fit engagement means within said body and having an unobstructed aperture formed in said body portion and a passage extending from said second snap-fit engagement means in said recess outwardly from said toy article to said opening, said toy being snap-fit secured to said nozzle to enclose said nozzle end within said body portion and said suction and pumping device and said toy article cooperating to cause a quantity of said malleable play material to be passed through said passage of said toy article and said nozzle to give the appearance of expelling and ingesting said play material by said toy article.

2. A suctioning and pumping activity playset as set forth in claim 1 wherein said hollow body further includes a housing supported by said hollow body and defining an interior storage cavity therein for receiving and storing at least one of said toy articles.

3. For use in combination with a malleable play material, a suctioning and pumping activity playset comprising:

a suction pump including, a generally cylindrical housing defining a cylindrical bore therein, a piston rod movable within said cylindrical bore having a first end within said bore and a second end extending therefrom, a piston supported upon said first end, a nozzle coupled to said generally cylindrical housing defining a nozzle end having an annular snap-fit ring and a nozzle passage therethrough; and an interrelated toy figure having a toy figure body, a passage defined therein and extending to the approximate center of said body and having an interior groove for receiving said snap-fit ring and for receiving a portion of said nozzle and securing said nozzle end within said toy article, an unobstructed aperture defined in said figure coupled to said passage, said nozzle end being partially received within said passage defined in said interrelated toy article in a snap-fit attachment to support said toy article and cause a quantity of said play material to be moved through said passage and said unobstructed aperture defined in said toy figure as said piston rod is moved within said cylindrical bore thereby giving said toy article the appearance of suctioning up and expelling said play material.

* * * * *